United States Patent [19]

Canter

[11] 4,093,287

[45] June 6, 1978

[54] CAR SEAL

[76] Inventor: George G. Canter, 2 Overlook Ave., Great Neck, Long Island, N.Y. 11021

[21] Appl. No.: 770,915

[22] Filed: Feb. 22, 1977

[51] Int. Cl.[2] ..... B65D 33/34

[52] U.S. Cl. ..... 292/317

[58] Field of Search ..... 292/323, 324

[56] References Cited

U.S. PATENT DOCUMENTS

| | | | |
|---|---|---|---|
| 896,244 | 8/1908 | Reesor | 292/324 |
| 1,112,123 | 9/1914 | Dow | 292/324 |
| 2,343,564 | 3/1944 | Mackey | 292/324 |
| 2,352,618 | 7/1944 | Daenz | 339/258 P X |
| 2,869,911 | 1/1959 | Dickey et al. | 292/324 X |
| 3,188,600 | 6/1965 | Woofter et al. | 339/217 S X |

FOREIGN PATENT DOCUMENTS

| | | | |
|---|---|---|---|
| 1,007,582 | 2/1952 | France | 292/323 |

*Primary Examiner*—Richard E. Moore

*Attorney, Agent, or Firm*—Cooper, Dunham, Clark, Griffin & Moran

[57] ABSTRACT

The invention relates to car seals for use on railroad freight cars, trucks, trailer trucks and the like, when it is desired to show at the point of destination whether the car has been tampered with. The seal provided by the present invention has a two piece cap and a sealing strip which engages in the two piece cap to provide the strap for overlapping the car door handle. In its preferred form the strap is formed of a strip which has an enlarged portion immediately behind its forward end which in final form provides inwardly-turned flanges to retain the forward end of the strip and the rearward end of the strip when inserted within the flanges, together with spring locking means which engage in coinciding holes in said strip to retain the same within the cap when the free end of the strip is inserted within the cap.

4 Claims, 15 Drawing Figures

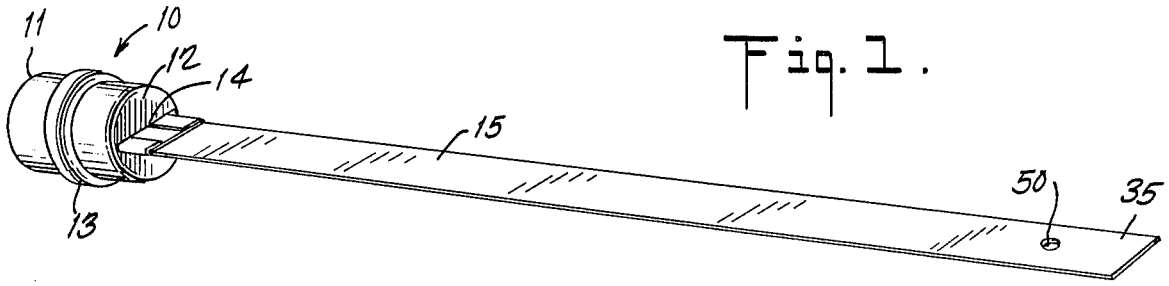
Fig. 1.
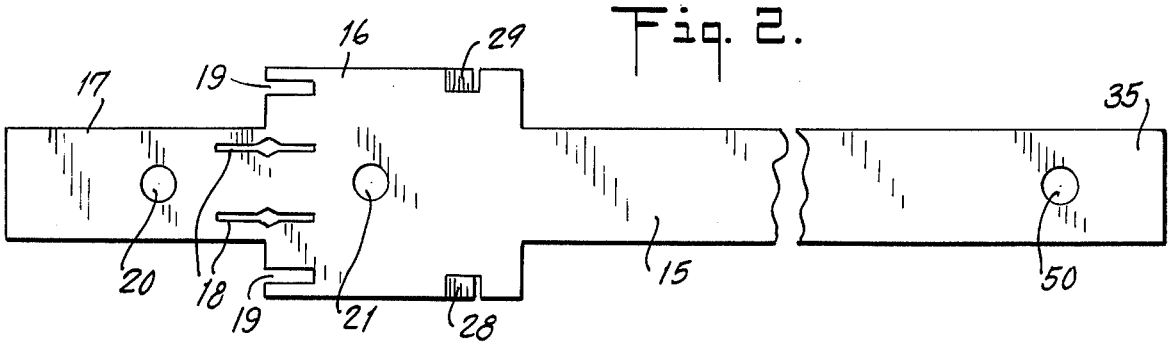
Fig. 2.
Fig. 3.
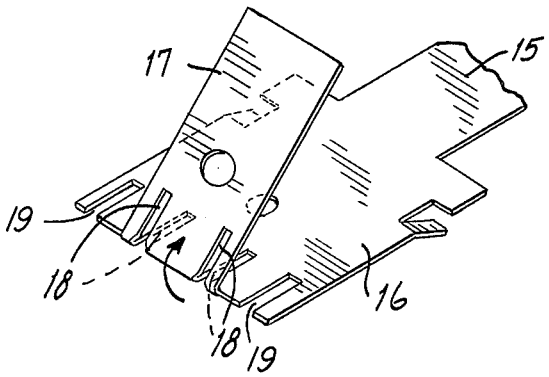
Fig. 4.
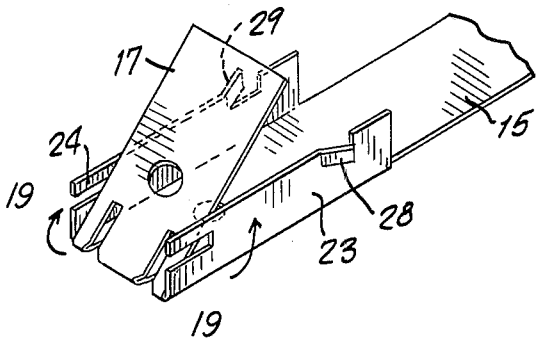
Fig. 5.
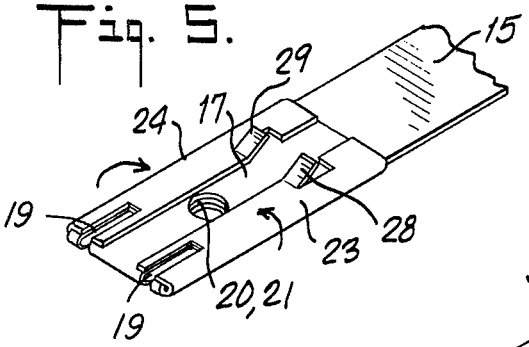
Fig. 6.
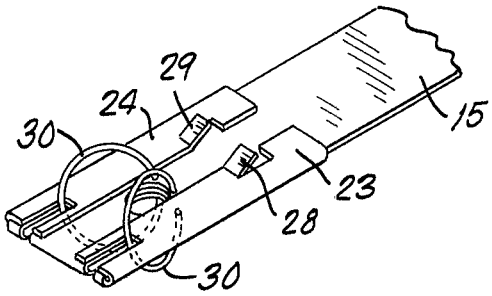

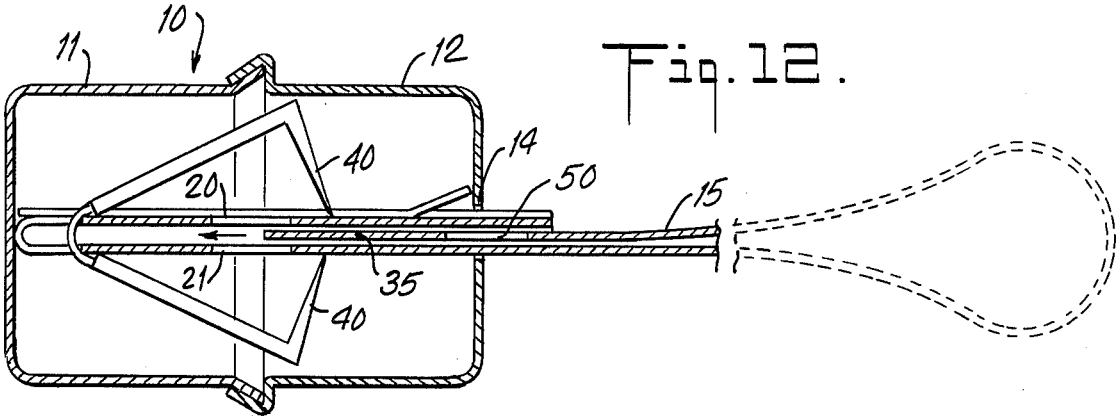
Fig. 12.
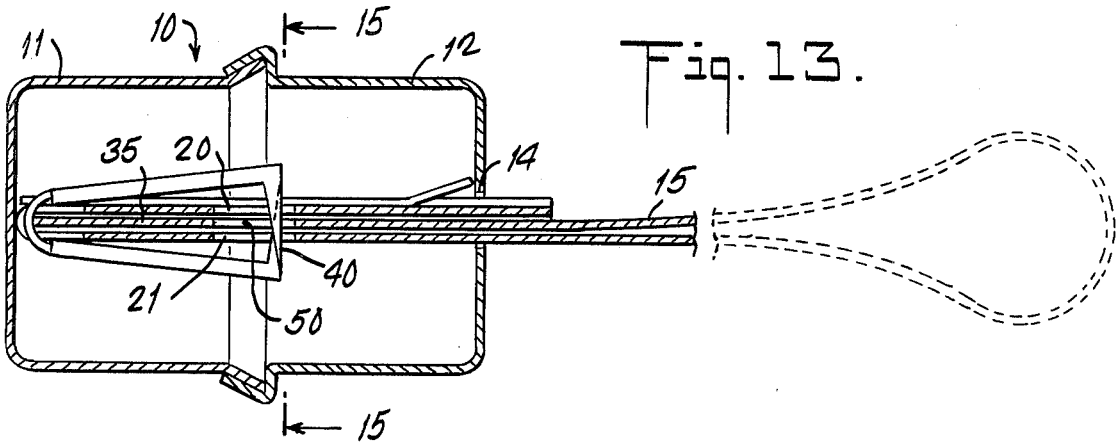
Fig. 13.
Fig. 14.
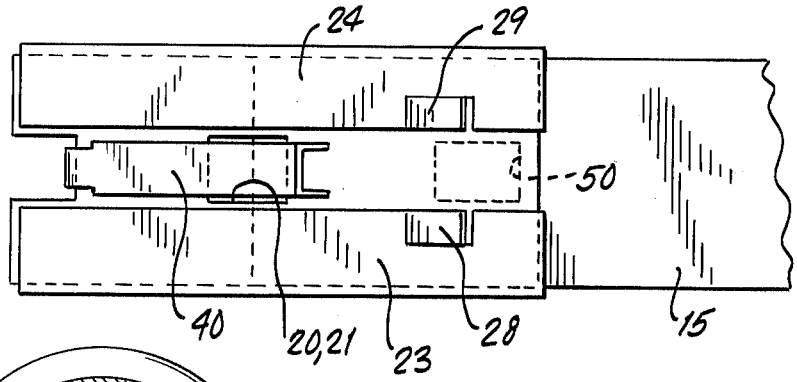
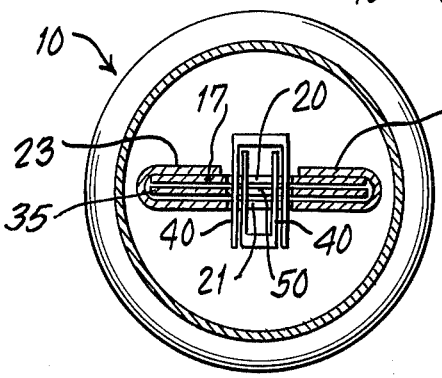
Fig. 15.

CAR SEAL

This invention relates to seals and to the method of forming them, the seal so formed being particularly adaptable as a car seal.

The general type of seal with which this application is concerned is well known in the art and usually includes a casing formed in two sections secured together, designed to hold one end of a sealing strip and having a limited means of access such as to permit the opposite end of the strip to be inserted and locked within the casing.

Seals typical of the types known in the prior art are those shown in U.S. Pat. Nos. 2,869,911 to W. J. Dickey, et al., 2,942,908 to K. R. McClure, 2,343,564 to A. S. Mackey, and 2,554,520 to G. G. Canter.

The principal feature of the present invention is that the strip has a forward end of the cross-sectional dimension of the strip and an enlarged section immediately adjacent thereto which is adapted to be folded over to provide a flanged area on the strip, — said strip between the forward end and the enlarged area being slotted to accommodate locking means, — said forward area when formed into the flanged locking area having means adapted to be positioned in locking connection within the casing of the seal. Another feature of the invention is that coinciding holes are provided in the folded over end of the strip and the flanged section for retention of spring split locking means and the like.

The present invention is illustrated in the accompanying drawings wherein:

FIG. 1 is a perspective view showing the two piece casing with the sealing strip before insertion of the free end of the strip in the casing.

FIG. 2 is a fragmentary plan view of the sealing strip prior to being formed for insertion in the two piece casing.

FIG. 3 is a fragmentary perspective view of the strip showing the first step in its forming.

FIG. 4 is a fragmentary perspective view showing the sealing strip in its second step of forming.

FIG. 5 is a fragmentary perspective view showing the sealing strip in its third step of forming.

FIG. 6 is a fragmentary perspective view of the sealing strip showing locking rings secured thereto.

FIG. 12 is a view similar to FIG. 9 and showing a modified form of the invention wherein spring steel gripping devices are used instead of split spring rings.

FIG. 13 is a view similar to FIG. 10 wherein the spring steel gripping devices are shown in locking engagement with the holes in the sealing strip.

FIG. 14 is a plan view of FIG. 13.

FIG. 15 is a cross-sectional view taken along the line 15—15 of FIG. 13.

Figure 7:
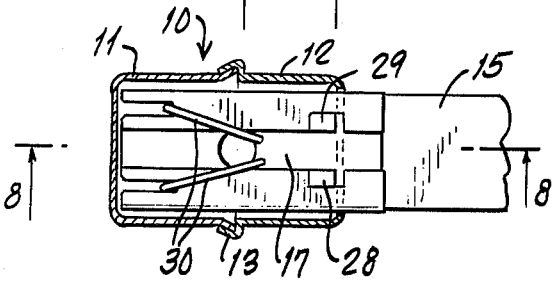
FIG. 7 is a fragmentary plan view, partially in section, of the car seal casing assembly.

Referring now to the drawings and particularly to FIG. 1, 10 represents a two piece cap comprising a top portion 11, a bottom portion 12 and a flange seam 13. The bottom portion 12 has an opening 14 of a size to receive the folded sealing strip. The sealing strip 15 has a longitudinal dimension such that it can encompass a car door handle to seal the same against tampering and to be locked in the two piece cap so as to prevent tampering or to reveal tampering.

The preferred strip of the present invention is shown in FIG. 2 in plan view, partially fragmentary, which shows the sealing strip 15 with enlarged section 16, a forward end 17, and having slots 18, 18, and 19, 19.

By referring to FIG. 3 it will be noted that the forward end 17 is adapted to be bent back over the enlarged area 16 so that the slots 18, 18 will overlap. It will also be noted in FIGS. 2 and 3 that there are provided holes 20 and 21 which will coincide when the forward end 17 overlaps the enlarged area 16 of strip 15.

By referring to FIG. 4 it will be noted that the sides of enlarged portion 16 of strip 15 are adapted to be folded upwardly so as to provide side walls 23, 24. As shown in FIG. 5 the side walls 23 nd 24 are further folded downwardly to provide overlapping flanges which encompass the forward end of strip 17 and bring the holes 20 and 21 into alignment, as well as the slots 19, 19 into coincidence with slots 18, 18.

It will also be noted that the side walls 23, 24 have struck up tongues 28, 29 which serve a purpose later to be described.

As illustrated in FIG. 6 and as well understood in the art split spring locking rings 30 may be applied to the forward end of the strip. According to one version of the invention these locking rings are positioned within the slots 18, 18 and 19, 19 and are held out of engagement with the coinciding holes 20, 21 prior to insertion of the end 35 of the strip into the cap 10. The open ends of the rings are maintained laterally in position between the flanges 23, 24 and in open position by the upper and lower faces of the strip 15.

Figure 8:
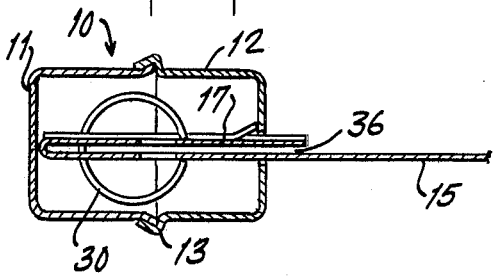
FIG. 8 is a fragmentary cross-sectional view of the sealing casing assembly taken along the lines 8—8 of FIG. 7.

The use of split spring rings such as 30 is well understood in the art as shown in U.S. Pat. Nos. 2,869,911 and 2,942,908. The assembly of such split rings with the cap and strip provided by the present invention is well illustrated in FIGS. 7 and 8 wherein the split rings (as best shown in FIG. 8) are out of engagement with coinciding holes 20, 21 of the flanged forward end 23, 24 of strip 15. The flanged forward end of strip 15 provides a slot 36 for reception of the end 35 of strip 15.

Figure 9:
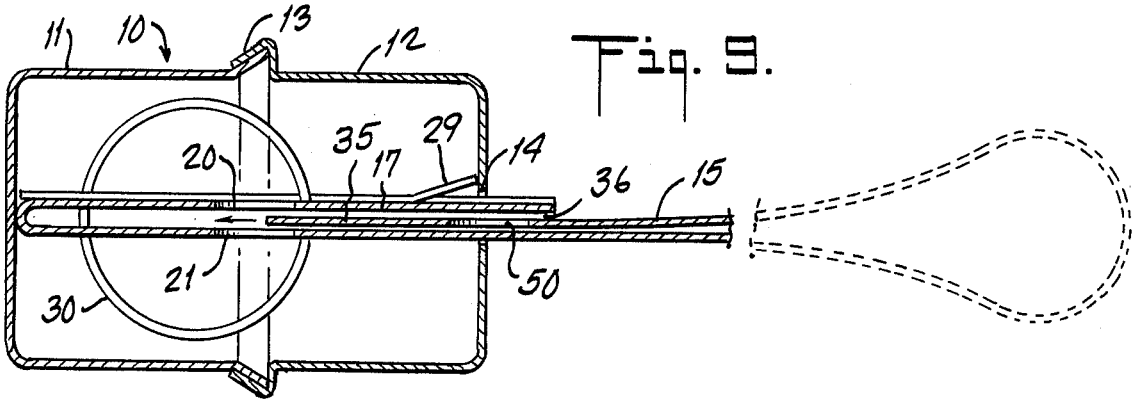
FIG. 9 is a cross-sectional view of the casing assembly prior to engagement of a locking ring, the portion of the strip which engages over the car door handle being shown in phantom.
Figure 10:
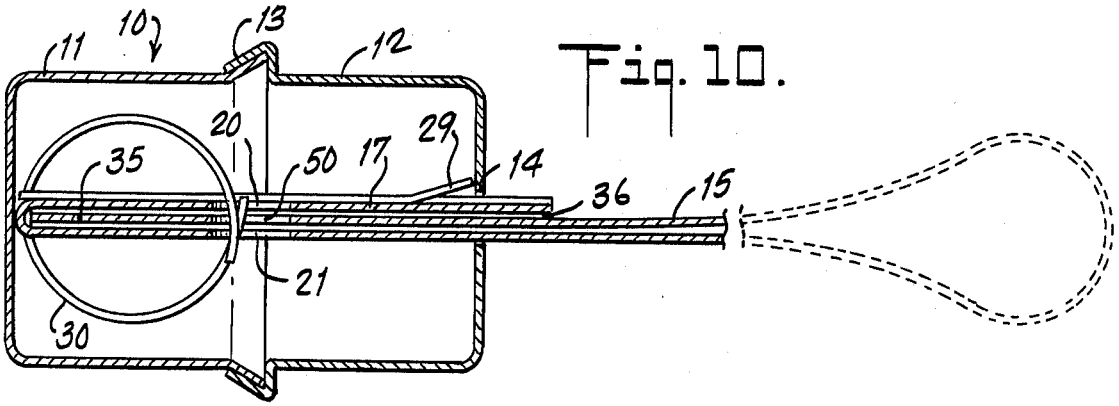
FIG. 10 is a view similar to FIG. 9 but showing the locking ring after it has been sprung into locking position.
Figure 11:
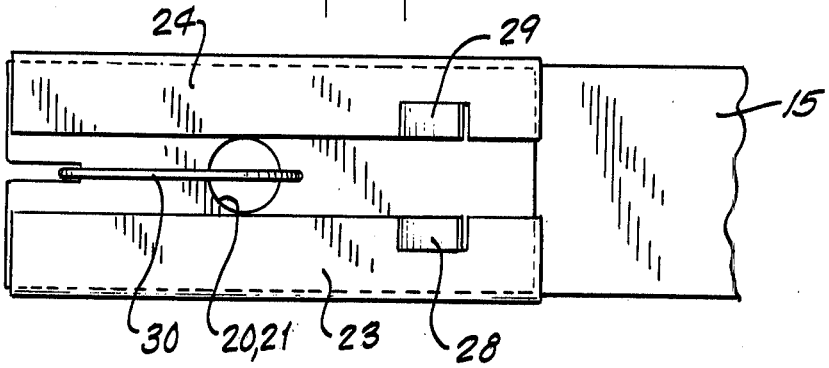
FIG. 11 is a plan view of FIG. 10.

As best seen in FIG. 9 the end 35 of the strip 15 when inserted within the flanged end of the strip into the cap 10 will displace the locking rings 30 from the position shown in FIG. 9 to the position shown in FIG. 10 and the spring ends of such locking springs will snap closed through the coinciding holes 20, 21 and 50 so as to retain the strip 15 in locked assembly with the cap 10.

Instead of using the conventional split locking rings, the present invention contemplates the use of triangular spring steel gripping devices as illustrated in FIGS. 12 to 15, wherein the spring ends 40 are spaced apart while in engagement with the forward end of strip 15 and until displaced by the outer end 35 whereupon they enter the coinciding holes 20, 21 and 50 at the free end of the strip 15.

What I claim is:

1. A car seal and the like comprising a two-piece cap and a sealing strip for overlapping a car door handle and the like, said two-piece cap disposed at substantially right angles to the plane of the strip, one of said sections having a slot therein, said strip of material at its outer free end being of a size and shape to pass through said slot, said strip of material at its opposite forward end and inwardly thereof having an enlarged section, said forward end being folded over said enlarged section in slightly spaced relation therewith, said enlarged section along its side edges also being folded over said forward end to provide flanges retaining the same in such folded-over position, said folded-over end of the strip, the enlarged portion of the strip, and said flanges having coinciding slots extending inwardly of their forward ends, spring-actuated locking means disposed in said coinciding slots, said flanges defining therebetween an area for laterally retaining said spring-actuated locking means in contact with the outer faces of the strip, said bent-over portions of the strip providing a longitudinal space therebetween to receive the outer free end of the strip, and holes in the free end of the strip and in the forward end of the strip between said flanges which coincide when said free end of the strip is inserted in the slot and pushed to the innermost end thereof, said spring-actuated means engaging in said coinciding holes in said strip to lock the same in position when said spring-actuated means are displaced by the free end of said strip.

2. A car seal according to claim 1, wherein struckup tongues are provided on the flanges and engage the inner face of the slotted section of the cap, to retain the forward end of the strip within the cap.

3. A car seal according to claim 1, wherein the spring-actuated locking means are split rings.

4. A car seal according to claim 1, wherein the spring-actuated locking means comprise a pair of spring-actuated triangular members.

* * * * *